US006131366A

United States Patent [19]

Fukuda

[11] Patent Number: 6,131,366

[45] Date of Patent: Oct. 17, 2000

[54] PACKAGING MACHINE WITH MECHANISMS FOR POSITIONING ITS FORMER

[75] Inventor: Masao Fukuda, Shiga, Japan

[73] Assignee: Ishida Co., Ltd., Kyoto, Japan

[21] Appl. No.: 09/481,827

[22] Filed: Jan. 12, 2000

Related U.S. Application Data

[62] Division of application No. 09/344,200, Jun. 24, 1999, Pat. No. 6,044,615, which is a division of application No. 09/057,407, Apr. 8, 1998, abandoned.

[30] Foreign Application Priority Data

Apr. 9, 1997 [JP] Japan ..... 9-091040

[51] Int. Cl.[7] ..... B65B 9/20; B65B 41/16; B65B 57/04

[52] U.S. Cl. ..... 53/64; 53/551; 53/389.4; 53/201

[58] Field of Search ..... 53/64, 168, 201, 53/551, 552, 389.4

[56] References Cited

U.S. PATENT DOCUMENTS

| | | | |
|---|---|---|---|
| 2,268,887 | 1/1942 | Matteson . | |
| 2,871,013 | 1/1959 | Markey . | |
| 4,054,251 | 10/1977 | Henderson et al. . | |
| 4,434,947 | 3/1984 | Focke . | |
| 4,519,185 | 5/1985 | Horn et al. . | |
| 4,766,716 | 8/1988 | Dominguez . | |
| 4,792,105 | 12/1988 | Imaseki . | |
| 5,237,798 | 8/1993 | Fukuda | 53/389.4 |
| 5,537,798 | 7/1996 | Fukuda et al. . | |
| 5,707,329 | 1/1998 | Pool et al. | 53/551 |
| 5,845,465 | 12/1998 | Bennett | 53/551 |

FOREIGN PATENT DOCUMENTS

| | | |
|---|---|---|
| 0067481 | 6/1982 | European Pat. Off. . |
| 0479594 | 10/1991 | European Pat. Off. . |
| 0549806 | 7/1993 | European Pat. Off. . |

*Primary Examiner*—John Sipos
*Attorney, Agent, or Firm*—Majestic, Parsons, Siebert & Hsue P.C.

[57] ABSTRACT

A packaging machine has a roll supporting device with a support shaft rotatably supporting a film roll which extends in an axial direction, an elongated bag-forming film being wrapped around the film roll, a bag forming device which pulls out the film from the film roll and forms the film into a shape of a bag, a packaging device for filling the bag-shaped film with articles to be packaged and sealing the film to produce a package, a roll displacing mechanism for displacing the roll supporting device in the axial direction, and a roll position controller for controlling the roll displacing mechanism to adjust the position of the roll supporting device. The bag forming device includes a former for bending the film into a tubular form and a former roller for guiding the film to the former. As a former of a different size is installed, depending on the width of the film, the position of the former roller is changed by a former roller discharging mechanism which includes a first mechanism for supporting the former roller and moving it to a plurality of different positions with respect itself and a second mechanism for moving the first mechanism to a plurality of different positions in the same direction.

6 Claims, 7 Drawing Sheets

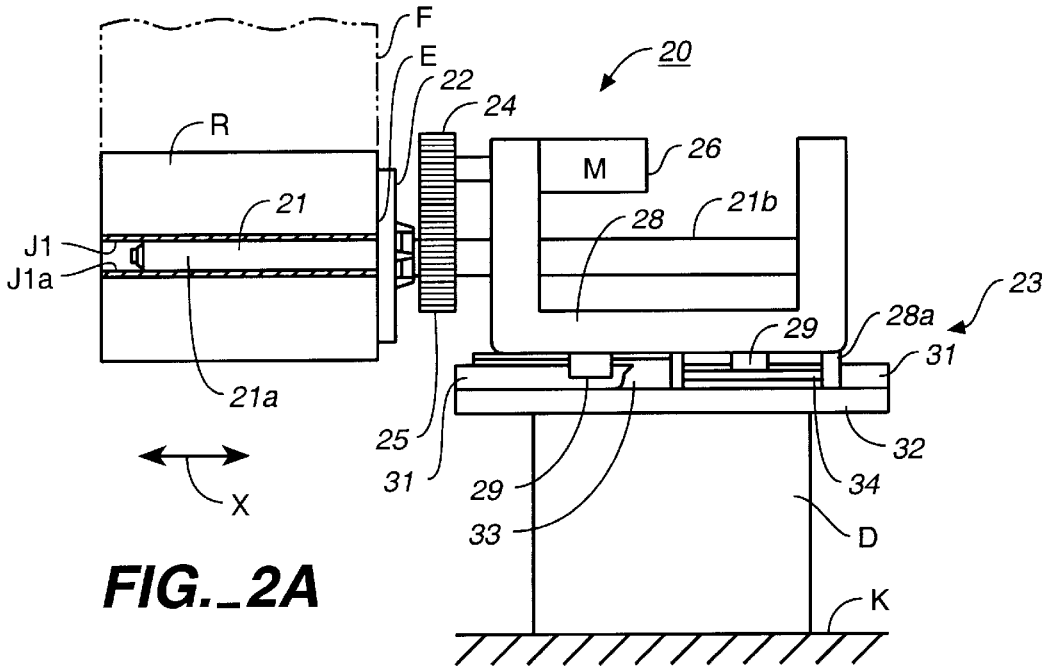
FIG._2A
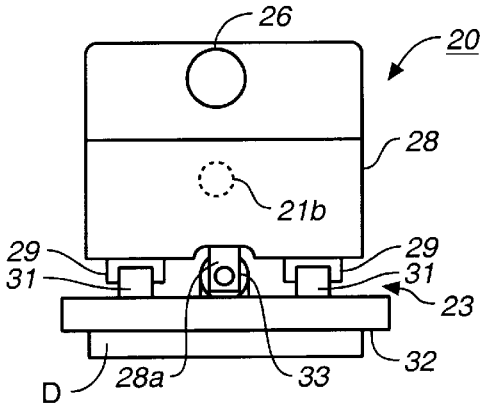
FIG._2B
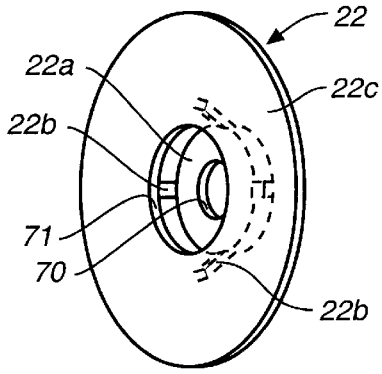
FIG._2C
FIG._2D
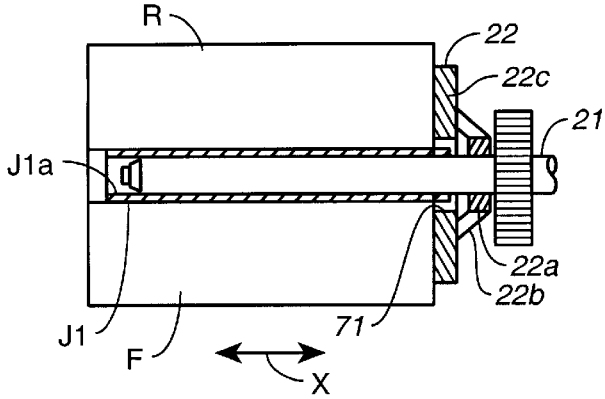

PACKAGING MACHINE WITH MECHANISMS FOR POSITIONING ITS FORMER

This is a divisional of applicant Ser. No. 09/344,200 filed Jun. 24, 1999 now U.S. Pat. No. 6,044,615 and is a divisional of application Ser. No. 09/057,407 filed Apr. 8, 1998 now abandoned.

BACKGROUND OF THE INVENTION

This invention relates to a form-fill-seal packaging machine for making packages by making bags with a flexible elongated web of bag-forming material (herein referred to as "film") and concurrently filling them with articles and sealing them, provided with an improved device for supplying a film to such a machine.

With a so-called pillow type packaging machine, as shown in FIG. 1, which is a kind of such a packaging machine, the film F is pulled out of a film roll R around which it is wound and is passed over a diagonally disposed turn bar 15 such that its direction of transportation T is changed by 90°. The turn bar 15 is moved in the axial direction of film roll R (shown by arrow X) according to its width W such that the center line of the film F will always pass over the centers of the guide rollers 3, 4, 5, 6 and 7 which guide the film F to a bag forming device S.

At the bag forming device S, the film F is passed over a former roller 8 to a former 9 by means of which the film F is bent into a tubular shape and its mutually overlapping side edges are sealed together by a longitudinal sealer 10 of a packaging device H. After the articles to be packaged are dropped into this tubularly shaped film F, a transverse sealer 11 seals the bag-shaped film F transversely and cuts it over the sealed area to produce individually separate filled bags B.

The film roll R is usually supported rotatably around a support shaft J1. With the kind of prior art packaging machine which requires each film roll to be loaded at a different position, depending on its length (or the width W of the film F wound therearound), it is time-consuming to properly adjust the position of the film roll R on the support shaft because the film roll R is usually large and heavy and hence is difficult to handle manually. In view of this problem, Japanese Patent Publication Tokkai 7-205934 disclosed a new technology according to which a film roll is placed on a positioning apparatus with a pair of plates for sandwiching the film roll and sliding it for correct positioning. This technology was not practical, however, because the mechanism for moving the two plates was complicated, besides being bulky.

Another problem to be dealt with has been that film rolls with different lengths must be used because the width of the film must be changed, depending on the size of the bags to be formed. FIG. 9 shows, as an example, prior art roll supporting device 20A on which film rolls Ra, Rb and Rc with different film widths Wa (small), Wb (medium) and Wc (large) are selectively loaded to the support shaft. When the smallest film roll Ra is set as shown in FIG. 9, the turn bar 15 (of FIG. 1) is placed at a position indicated by symbol 15*a* such that the film pulled out of it will change its direction of motion by 90° so as to move in the axial direction of the film roll R (the X-direction) towards the bag forming device S (as shown in FIG. 1). For this purpose, the center line Oa of the film as it is pulled out of the film roll R passes through the center position O1*a* of the turn bar position 15*a*. Similarly, symbols 15*b* and 15*c* indicate the positions of the turn bar 15 when the film rolls Rb and Rc are loaded on the support shaft and the center lines Ob and Oc of the films with widths Wb and Wc will pass through the centers O1*b* and O1*c* of the turn bar positions 15*b* and 15*c*. When a small film roll Ra is replaced by a medium-sized film roll Rb, the distance by which the turn bar 15 should be moved is indicated by L5 (or (Wb−Wa)/2) which is relatively small. When the small film roll Ra is replaced by a large film roll Rc, however, this distance will be L6 (or (Wc−Wa)/2) which is quite large. In other words, as the difference in width of film between the smallest and the largest to be accommodated is increased, the mechanism for moving the turn bar 15 in the X-direction becomes correspondingly large and the packaging machine as a whole becomes also large.

When a film with a different width is used, the size of the former to be set in the bag forming device S must usually be changed also. As a small former 9*a* is replaced by a medium-sized former 9*b* and then by a large former 9*c*, as shown in FIG. 10, the former roller 8 must also be moved correspondingly from a closer position 8*a* to an intermediate position 8*b* and then to a farther position 8*c*. When a small film roll Ra is replaced by a medium-sized film roll Rb and the smaller former 9*a* is correspondingly replaced by the medium-sized former 9*b*, the distance by which the former roller 8 should be moved is L7, which is relatively small. When the small film roll Ra is replaced by a large film roll Rc and the smaller former 9*a* is replaced by the larger former 9*c*, however, this distance is L8, which is significantly larger than L7.

In summary, in order to be able to make bags with a wide range of widths, the packaging machine must be able to accommodate film rolls of different lengths and to move the turn bar and the former roller accordingly by much larger distances. This means that the mechanisms for moving the turn bar and the former roller become larger and the packaging machine itself becomes large.

SUMMARY OF THE INVENTION

It is therefore an object of this invention to provide a packaging machine with which the problems described above can be overcome.

Explained more in detail, an object of this invention is to provide a packaging machine capable of making bags with different widths without requiring large mechanisms for adjusting the positions of the turn bar and/or the former roller.

A packaging machine according to this invention may be characterized as comprising a roll supporting device with a support shaft rotatably supporting a film roll with an elongated bag-forming film wrapped therearound, a bag forming device which pulls out the film from the film roll and forms it into the shape of a bag, a packaging device for filling the bag-shaped film with articles to be packaged and sealing the film to produce a package, a roll displacing mechanism for displacing the roll supporting device in the axial direction of the film roll, and a roll position controller for controlling the roll displacing mechanism to adjust the position of the roll supporting device. The roll displacing mechanism serves to displace the film roll in the axial direction according to the width of the film such that the total distance by which the roll displacing mechanism displaces the film roll in the axial direction will be less than one half of the difference in width between the widest and the narrowest of the films to be accommodated. With a packaging machine thus structured, the fine positioning of the film roll can be automated because the roll supporting device which supports the film roll is itself moved automatically in the axial direction of the roll. Thus, the work efficiency can be significantly improved. Since the pair of plates for sandwiching the film roll and the mechanism for sliding it for correct positioning according to the aforementioned prior art technology can be dispensed with, the packaging machine according to this invention need not be bulky.

The packaging machine may be of a type having a turn bar disposed diagonally to the film being pulled out of the film roll for causing the film, after being pulled out of the film roll, to change the direction of motion perpendicularly while contacting its surface. A control unit for the packaging machine may then include turn bar position control means for adjusting the position of the turn bar according to the width of the film and roll position control means for adjusting the position of the roll supporting device also according to the width of the film. According to this invention, the position of the roll supporting device is controlled such that the position of the turn bar does not have to be changed much even if a film of a much different size is used and the total size of the packaging machine does not have to be increased.

The support shaft is inserted into a central opening of the film roll in the axial direction. A stopper is attached to the support shaft for contacting a backward surface of the film wrapped around the film roll when the film roll is mounted to the support shaft. The stopper includes an attachment which is attached to the support shaft and a stopper member which is attached to this attachment and is at a displaced position displaced in a forward direction with the stopper member contacting the backward surface of the film without contacting the film roll. In this manner, the film roll can be positioned easily, having its back surface in the axial direction caused to contact the stopper member. Since the stopper member contacts the film but not the film roll, the film can be dependably positioned correctly even if the film roll protrudes somewhat from the film which has been wrapped therearound.

The packaging machine may be adapted to use formers of different sizes and may include a former roller for guiding the film to the former and a former roller displacing mechanism which serves to move the former roller to a suitable position according to the size of the selected former along the film transportation direction. The former roller displacement mechanism includes a first mechanism for supporting the former roller and moving it to a plurality of different positions with respect thereto in the film transportation direction and a second mechanism for moving the first mechanism to a plurality of different positions in the film transportation direction. In this manner, since the total distance by which the second mechanism has to be moved is reduced by the distance by which the first mechanism is moved by the second mechanism, the total size of the packaging machine does not have to increase much even if films of different width are to be accommodated. According to a preferred embodiment of the invention, the first mechanism includes a rotary member which supports the former roller and is rotatable around an axis perpendicular to the film transportation direction, and the second mechanism includes a screw mechanism for causing this rotary member to undergo a linear motion in the film transportation direction. The control unit of the packaging machine may further include a former roller control means for controlling the former roller displacement mechanism to adjust the position of the former roller in the direction of transportation of the film according to the width of the film. In this manner, the position of the former roller can be effectively adjusted by a relatively simple structure and the adjustment can be carried out automatically.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIG. 2A is a partly sectional side view of the roll supporting device of the packaging machine of FIG. 1, FIG. 2B is the back view of a portion of the roll supporting device of FIG. 2A, FIG. 2C is a diagonal view of the roll stopper shown in FIG. 2A, and FIG. 2D is another partly sectional view of a portion of the roll supporting device when the core of the film roll is displaced;

DETAILED DESCRIPTION OF THE INVENTION

Figure 1:
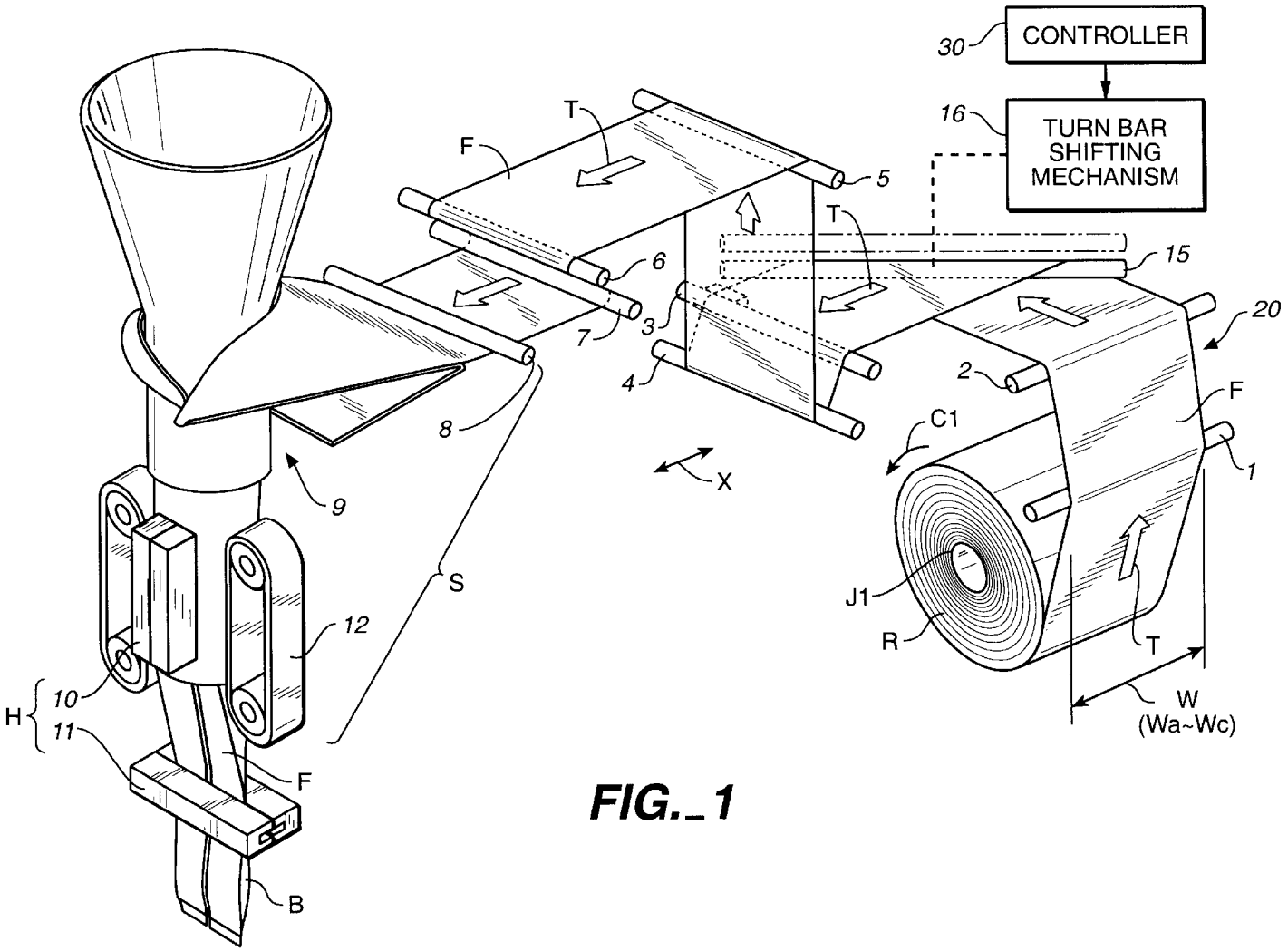
FIG. 1 is in part a schematic diagonal view and in part a block diagram of a packaging machine embodying this invention.

The invention is described next by way of an example. FIG. 1 shows a form-fill-seal packaging machine embodying this invention of the so-called vertical pillow type for forming a bag, concurrently filling it with articles to be packaged and sealing it. The elongated material with which the bags are formed is herein referred to as the film F. Films of different widths (such as Wa, Wb and Wc, indicated summarily by letter W) are used in the form of a film roll R. The film F, after being pulled out of a film roll R on a roll supporting device 20, is passed over a first guide roll 1 and a second guide roll 2 and is led to a turn bar 15 which is positioned diagonally to the longitudinal direction of the film F and serves to change its direction of motion (indicated by arrows T) by 90° while contacting one of its surfaces. The turn bar 15 can be moved, without changing the direction of its orientation, in the axial direction X of the film roll R by means of a turn bar shifting mechanism 16 adapted to support the turn bar 15 at both its ends.

The film F is transported horizontally after its direction of motion is changed by means of the turn bar 15 and changes its direction of motion upward by going over a third guide roll 3 and a fourth guide roll 4. After the film F is passed over a fifth guide roll 5, it is transported horizontally again, and it travels on a zigzag path by passing over a sixth guide roll 6 and a seventh guide roll 7 before reaching a bag forming device S. In the bag forming device S, the film F is directed by means of a former roller 8 to a former 9 by means of which it is bent into a tubular form and is at the same time pulled downward by means of a pair of pull down belts 12 disposed opposite each other below the former 9 such that it is transported downward to a packaging device H while maintaining its tubular shape. In the packaging device H, the mutually overlapping side edge parts of the film F are longitudinally sealed together by means of a longitudinal sealer 10 into the shape of a bag, and after it is filled with articles to be packaged, the bag-shaped film F is transversely sealed by means of a transverse sealer 11 and cut such that a packaged bag B is produced. The aforementioned operations of the bag forming device S and the packaging device H are controlled by a controller 30.

As shown in FIG. 2A, the film roll R is rotatably supported in the roll supporting device 20 which is supported slidably on a table D affixed to a base K which supports the packaging machine as a whole, comprising a support shaft 21 which is horizontally extended in the X-direction and a roll stopper 22 provided at a middle part of this support shaft 21 in its longitudinal direction. The support shaft 21 contains an air chuck (not shown) in its forward end part 21*a* and this chuck is expanded after this forward end part 21*a* of the support shaft 21 in inserted into the center bore J1*a* of the core J1 of the film roll R and while the back end surface E of the film roll R in its axial direction X such that the chuck is compressed against the inner surface of the core J1 and that the film roll R is axially supported by the support shaft 21.

As shown in FIG. 2C, the roll stopper 22 comprises a ring-shaped stopper member 22*c* with a central opening 71 attached through a plurality of stays 22*b* to a ring-shaped back member 22*a* with a smaller central opening 70. This back member 22*a* is attached to the support shaft 21 by means of a radially oriented bolt (not shown) with its central opening 70 engaged with the support shaft 21. The stopper member 22*c* is forwardly (towards the left in FIG. 2A) displaced from the back member 22*a* in the X-direction towards the forward end of the support shaft 21 (to the left with reference to FIG. 2A) and contacts at this forwardly displaced position with the back end surface E of the film roll R. The central opening 71 of the stopper member 22*c* has a larger inner diameter than the outer diameter of the core J1 of the film roll such that the core J1 will pass through this central opening 71 and will not hit the stopper member 22*c* even if the core J1 happens to be displaced backward with respect to the film F which is wrapped therearound, as shown in FIG. 2D. Thus, it is the plane determined by the back end surface E of the rolled film F, not the core J1 of the film roll R, that contacts the front surface of the stopper member 22*c*, and the axial position along the X-axis of the film roll R can be accurately determined.

As shown in FIGS. 2A and 2B, a bracket 28 is provided to rotatably support a back part 21*b* of the support shaft 21 without allowing the support shaft 21 to slide in the axial direction with respect to the bracket 28. The roll supporting device 20 according to this invention is characterized as comprising a roll displacing mechanism 23 for controlling the displacement in the X-direction of the roll stopper 22 according to the width W of the film F on the film roll R such that the change in the center position in the X-direction of the film roll R can be controlled. In an example where there are three film widths Wa, Wb and Wc to be considered, the displacement may be effected in two stages, but the mechanism may be designed such that the displacement is effected in three or more stages, depending on the number of different film widths W.

As shown in FIGS. 2A and 2B, the roll displacing mechanism 23 comprises a pair of rails 31 which extend in the X-direction and are affixed to a table top member 32 attached to the table D and a cylinder 33 disposed between this pair of rails 31. The cylinder 33 is provided with a rod 34 which can be extended or retracted in the X-direction. The tip of this rod 34 is connected to a connector member 28*a* extending downward from the bracket 28 which is supported by the rails 31 slidably in the X-direction through a plurality of linear bearings 29 attached to its bottom surface. In other words, the bracket 28 can be displaced in the X-direction along the rails 31 as the cylinder 33 causes its rod 34 to extend or retract, and the roll stopper 22 supported by the support shaft 21.

A driving motor (referred to as "the shaft rotating motor") 26 is also attached to the bracket 28. A gear 24 which is affixed to its drive shaft engages with another gear 25 affixed to a center part of the support shaft 21. Under the control of the controller 30, the shaft rotating motor 26 is activated such that the support shaft 21 and the film roll R are caused to rotate in the direction of arrow C1 shown in FIG. 1 and the tension inside the film F can be controlled.

Figure 3A:
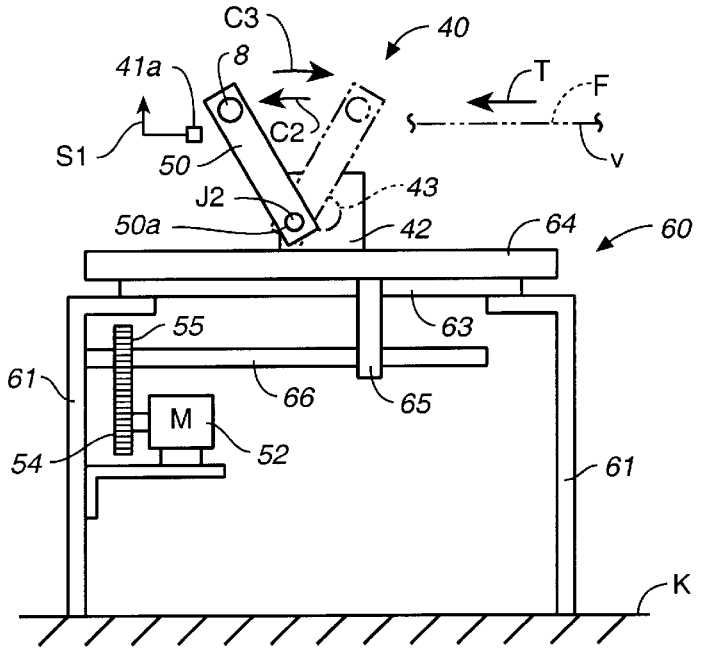
FIG. 3A is a side view of the former roller displacing mechanism of the packaging machine of FIG. 1.

The bag forming device S according to this invention is characterized as comprising a former roller displacing mechanism 40 for changing the position of the former roller 8 along the transportation path V (in the direction indicated by arrow T) of the film F in three stages corresponding to the length of the former 9 which changes according to the film width W. As shown in FIG. 3A, this former roller displacing mechanism 40 comprises a pair of rotary left and right arms (referred to as "the first mechanism") for supporting the former roller 8 at its both ends and causing it to undergo a rotary motion and to thereby set it at two different positions along the aforementioned transportation path V of the film F and means such as a screw mechanism 60 (referred to as "the second mechanism") for causing these rotary arms 50 to undergo a linear motion along the transportation path V.

Figure 5:
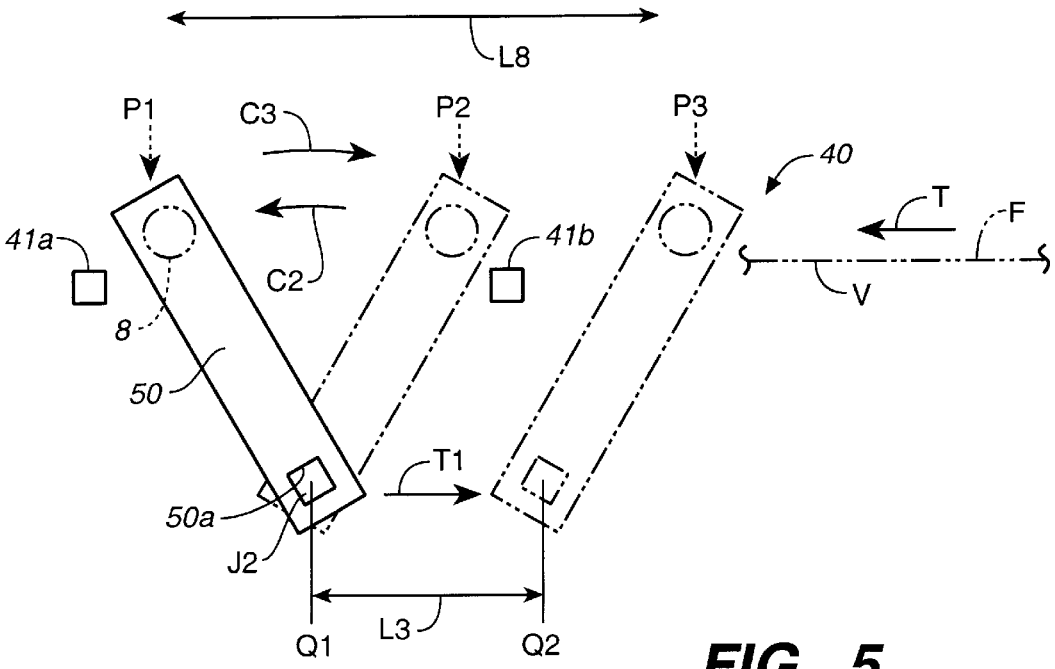
FIG. 5 is a schematic side view of a portion of the packaging machine of FIG. 1, showing the motion of the rotary arms.

The screw mechanism 60 comprises a pair of rails 63 supported by a frame 61 affixed to the base K. A slidable table 64 is placed on these rails 63 so as to be slidable thereover along the aforementioned transportation path V, and a supporting block 42 for supporting the aforementioned rotary arms 50 is affixed to this slidable table 64. Another driving motor (referred to as "the table sliding motor") 52 is attached to this frame 61. A gear 54 which is affixed to the drive shaft of the table sliding motor 52 is engaged with another gear 55 affixed to a screw bar 66 extending parallel to the rails 63. This screw bar 55 is itself a connecting member 65 attached to the bottom surface of the slidable table 64, and its front end is rotatably supported by the frame 61. Thus, as the table sliding motor 52 is activated and the gears 54 and 55 are rotated, the screw bar 66 is also rotated and this causes the slidable table 64 connected to the connecting member 65 to move on the rails 63 along the transportation path V of the film F. As the slidable table 64 is thus caused to slide on the rails 63, the axis of rotation of the rotary arms 50 is also moved (say, from position Q1 to position Q2 as shown in FIG. 5). The exact position of this axis of rotation can be determined by detecting the angle of rotation of the table sliding motor 52 by means of an optical detector such as a rotary encoder.

Figure 3B:
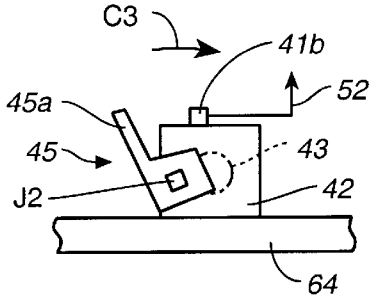
FIG. 3B is a side view of a portion of the former roller displacing mechanism of FIG. 3A.

The supporting block 42 is positioned between the pair of rotary arms 50 which it supports and contains therein still another driving motor (referred to as "the arm rotating motor") 43, the drive shaft of which is in a motion-communicating relationship through a gear mechanism of a known kind with a sectionally square shaft J2 penetrating square throughholes 50*a* formed through the pair of rotary arms 50. Thus, as the arm rotating motor 43 is activated, the rotary arms 50 be rotated around its axis of rotation selectably in the directions indicated by arrows C2 and C3. A positioning switch 41*a* such as a proximity switch for detecting the angular position of the rotary arms 50 and thereby stopping their motion is disposed at a specified position near the forward end of the trajectory of the rotary arms 50. As shown in FIG. 3B, furthermore, another positioning switch 41*b* such as a microswitch for detecting the position of the rotary arms 50 and thereby stopping their motion is disposed at a specified position on the upper surface of the supporting block 42, and a pushing member 45 with a protrusion 45*a* is affixed to the square shaft J2 for the rotary arms 50 near the supporting block 42 such that, as the rotary arms 50 rotate in the direction of arrow C3 by a certain specified angle, the pushing member 45 is rotated accordingly and its protrusion 45*a* applies a force on the microswitch 41*b*.

Figure 4:
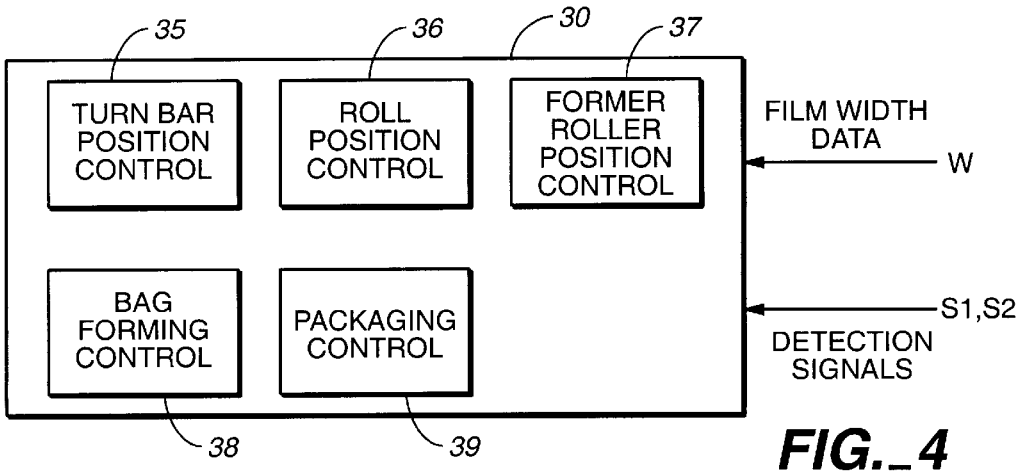
FIG. 4 is a block diagram of the controller for the packaging machine of FIG. 1.

As the arm rotating motor 43 is activated to rotate the rotary arms 50 in the direction of arrow C2 and the proximity switch 41*a* detects the rotary arms 50 at a specified position (as indicated by symbol P1 in FIG. 5) and is thereby switched on, a detection signal S1 is thereby outputted and received by the controller 30 (as symbolically shown in FIG. 4) and the rotary motion of the rotary arms 50 is thereby stopped. When the film width is Wa (or when a film with the smallest width is being used), the rotary arms 50 are set at this position P1. Similarly, as the arm rotating motor 43 causes the rotary arms 50 to rotate in the opposite direction (in the direction of arrow C3) and the protrusion 45*a* of the pushing member 45 pushes in the microswitch 41*b*, the presence of the rotary arms 50 at position P2 (shown in FIG. 5) is detected, another detection signal S2 is thereby outputted and received by the controller 30 (as schematically shown in FIGS. 3B and 4) and the rotary motion of the rotary arms 50 is stopped. When the film width is Wb (or when a film with an intermediate width is being used), the rotary arms 50 are set at this position P2.

The controller 30, of which the structure is schematically shown in FIG. 4, is adapted to control the overall operation of the packaging machine. Its functions include automatically controlling the operations of various components on the basis of inputted data on the film width W and the detection signals S1 and S2. Thus, the controller 30 includes a turn bar position control means 35 for controlling the motion and positioning of the turn bar 15, a roll position control means 36 for controlling the motion and positioning of the roll stopper 22, a former roller position control means 37 for controlling the motion and positioning of the former roller 8, a bag forming control means 38 for controlling the operations of the bag forming device S and a packaging control means 39 for controlling the packaging device H.

The bag forming control means 38 serves, for example, to position the pull down belts 12 and to change the speed of transportation of the film F, depending on the type of the former 9 selected in accordance with the film width W. The packaging control means 39 serves, for example, to position the longitudinal and transverse sealers 10 and 11 and to set their temperatures and sealing pressures, depending similarly on the type of the former 9 selected in accordance with the film width W. When the information on the film width W is erroneously inputted, the controller 30 also serves to output an alarm such that operations based on such an erroneous information will be forbidden.

Next, switching operations of various parts will be explained as the film width W is switched from the small (Wa) to the large (Wc). The small film width Wa may be, for example, for making bags of 5-inch size, the intermediate film width (Wb) may be, for example, for making bags of 9-inch size, and the large film width (Wc) may be, for example, for making bags of 13-inch size.

Let us consider a situation where the film width is small or intermediate (Wa or Wb). First, a former 9 and a film roll R of correspondingly appropriate kinds are selected and installed. Next, the controller 30 carries out various adjustments according to the inputted film width Wa or Wb.

After the former 9 has been selected, the former roller position control means 37 controls the former roller displacing mechanism 40 to appropriately position the former roller 8 as shown in FIG. 5. Explained more in detail, after the small film width Wa is indicated, the arm rotating motor 43 rotates the rotary arms 50 in the direction of arrow C2, and when the proximity switch 41*a* detects the rotary arms 50 at position P1, it is switched on and the detection signal S1 is outputted, thereby causing the motion of the rotary arms 50 to be stopped. The former roller 8 is thus set at position P1 corresponding to the small film width Wa.

If the intermediate film width Wb is inputted, the arm rotating motor 43 rotates the rotary arms 50 in the direction of arrow C3, and when the microswitch 41*b* detects the rotary arms 50 at position P2, it is switched on and the detection signal S2 is outputted, thereby causing the motion of the rotary arms 50 to be stopped. The former roller 8 is thus set at position P2 corresponding to the intermediate film width Wb.

If the film width is Wm1 which is between the small and intermediate values (that is, Wa<Wm1<Wb), the screw mechanism 60 is used while the rotary arms 50 are kept at position P1. Explained more in detail, if such a film width Wm1 is inputted, when the detection signal S1 is received by the controller 30 and it is ascertained that the rotary arms 50 are at position P1, the screw mechanism 60 is activated and causes the axis of rotation of the rotary arms 50 to undergo a linear motion from position Q1 in the direction T1 opposite to the direction T along the transportation route V by a specified distance corresponding to the length of the former selected by this film width Wm1. This specified distance is smaller than the distance L3 between positions Q1 and Q2.

Figure 6A:
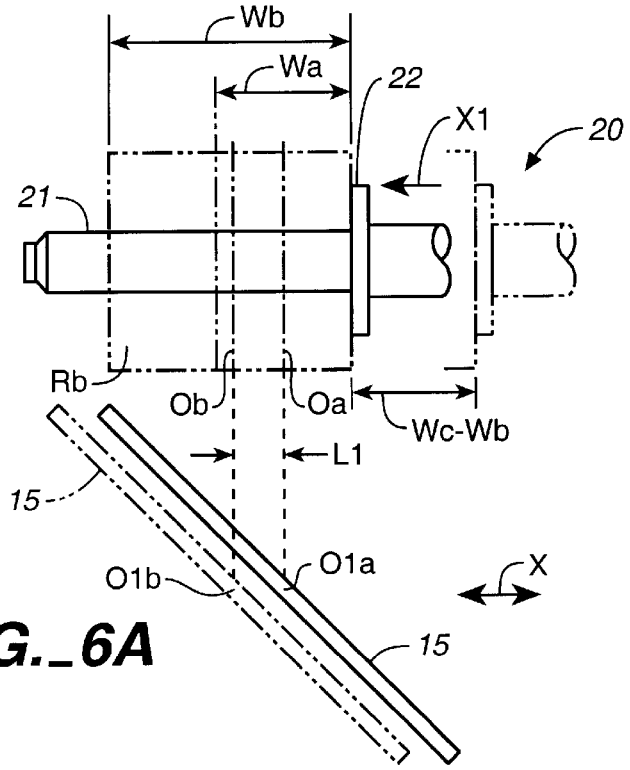
FIGS. 6A and 6B are schematic plan views of a portion of the packaging machine of FIG. 1, showing the film roll supporting device at different positions, together with the positions of the turn bar.
Figure 6B:
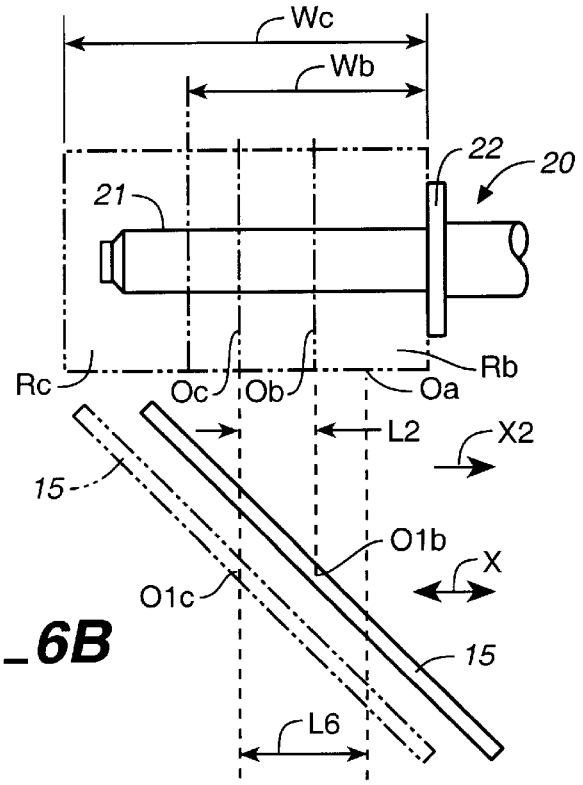

Next, the roll position control means 36 controls the roll displacing mechanism 23 to adjust the position of the roll stopper 22. FIG. 6B shows the roll stopper 22 at a position determined for a film F with the largest width value Wc. If a small or intermediate film width Wa or Wb is then inputted, the cylinder 33 of the roll displacing mechanism 23 is activated and the roll stopper is moved as shown in FIG. 6A in the direction indicated by arrow X1 by a distance equal to (Wc−Wb). The control is made such that the center positions Oa and Ob in the X-direction corresponding respective to a narrow film roll Ra and an intermediate film roll Rb with film width Wa and Wb will be as close as possible to the center position Oc in the X-direction of a wide film roll Rc with film width Wc as shown in FIG. 6B.

The aforementioned center lines Oa and Ob of the narrow and intermediate film rolls Ra and Rb pass correspondingly through the center positions O1*a* and O1*b* of the turn bar 15 when adjusted for these film rolls, as shown in FIG. 6A. Thus, the distance between the center lines Oa and Ob of the film rolls Ra and Rb and the distance between the center positions O1*a* and O1*b* of the turn bar 15 corresponding to these two film rolls Ra and Rb are the same (=L1), as shown in FIG. 6A. In other words, L1 is the distance in the X-direction by which the turn bar 15 should be moved by means of the turn bar shifting mechanism 16, as the position of the roll stopper 22 is thus changed. It now goes without saying that the distance by which the turn bar 15 should be moved in the X-direction will be smaller than L1 if the film width Wm1 is such that Wa<Wm1<Wb.

For the bag forming device S, the bag forming control means 38 serves to control the positioning of the pull down belts 12 according to the kind of the former 9 selected corresponding to the film width W and the speed of transportation of the film F determined by the rotational speeds of the pull down belts and the film roll. For the packaging device H, the packaging control means 39 serves to control the positioning of the longitudinal and transverse sealers 10 and 11 according to the kind of the former 9 selected corresponding to the film width W, as well as the sealing temperatures and the sealing pressures of these sealers. The controller 30 also serves to output an alarm signal if data input is carried out corresponding to a small film width Wa, for example, although the actual film width is Wc or to prevent the input of such data.

Thus, if the film width is Wa or Wb, various parts of the packaging machine are adjusted as described above and the film F is supplied from the film roll R under this condition, the film F is formed into a bag at the bag forming device S, articles are supplied into the bag at the packaging device H, and a filled bag B is produced.

Figure 10:
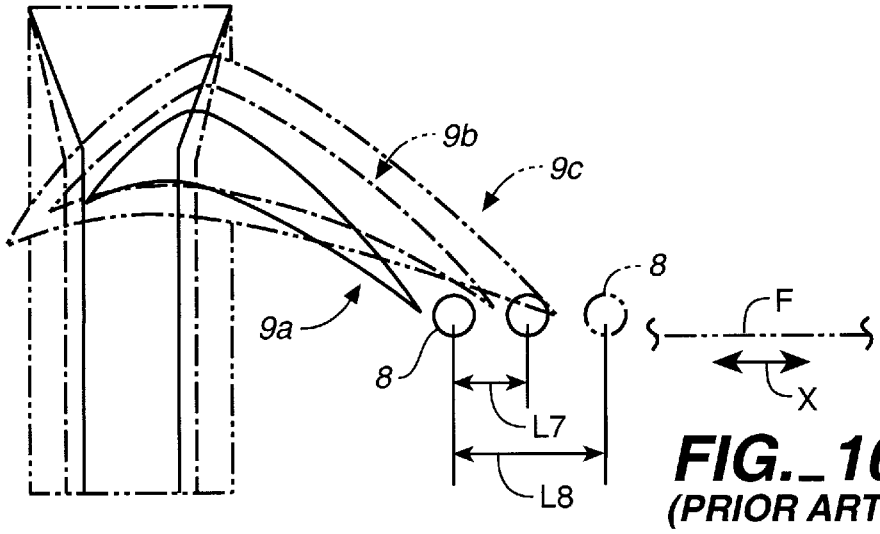
FIG. 10 (PRIOR ART)
FIG. 10 is a schematic side view of a portion of a prior art packaging machine, showing the positions of its former roller according to the size of the former.

In the case of a film with a large width Wc, another former 9 of a different type and a wide film roll Rc corresponding to the inputted film width Wc are set. For this former 9, the roll position control means 36 controls the former roller displacing mechanism 40 to position the former roller 8. In this case, the arm rotating motor 43 causes the rotary arms 50 to rotate in the direction of arrow C3 as shown in FIG. 5 until the microswitch 41*b* detects the rotary arms 50 at position P2 and is thereby switched on, stopping the rotation of the rotary arms 50. As the detection signal S2 is received by the controller 30 and the presence of the rotary arms 50 at position P2 is thereby ascertained, the screw mechanism 60 causes the axis of rotation of the rotary arms 50 to move linearly from position Q1 to position Q2 as shown in FIG. 5 in the direction of arrow T1 opposite the direction of film transportation T along the film transportation path V by a distance L3 depending upon the size of the newly installed former 9. As a result, the former roll 8 is now at position P3 shown in FIG. 5. The distance between positions P1 and P3 is the same as the distance by which the former roller of a prior art packaging machine will have to be moved as explained above with referenced to FIG. 10, that is, it is L8.

If a film width Wm2 which is between Wb and Wc (that is, if Wb<Wm2<Wc) is inputted, after the detection signal S2 is received by the controller 30 and the presence of the rotary arms 50 at position P2 is thereby ascertained, the screw mechanism 60 causes the axis of rotation of the rotary arms 50 to move linearly from position Q1 in the direction of arrow T1 as shown in FIG. 5 to a specified position determined by the kind of the former 9 corresponding to the inputted film width Wm2. The distance by which the axis of rotation of the rotary arms 50 in this case is smaller than L3.

Alternatively, the former roller displacing mechanism 40 may be structured such that the supporting block 42 of the rotary arms 50 is moved first to position Q2 by means of the screw mechanism 60 and then the rotary arms 50 are rotated to position P2 or position P3 corresponding respectively to film width Wb and Wc.

It is to be noted that the former roller displacing mechanism 40 thus structured, when the film width W is changed, moves the former roller 8 both by rotating the rotary arms (or the first mechanism) 50 and by moving the screw mechanism (or the second mechanism) 60 linearly. Thus, even. if the film width W is changed by a relatively large amount, the distance by which the former roller must be moved by the screw mechanism 60 is much less than required by a prior art packaging machine. In other words, the present invention can prevent the packaging machine from becoming too large.

Next, the roll position control means 36 controls the position of the roll stopper 22 through the roll displacing mechanism 23. As shown in FIG. 6B, the roll stopper 22 is moved in the direction of arrow X2 by (Wc−Wb). Since the center line Oc of the wide film roll Rc passes through the center position O1*c* of the turn bar 15, as shown in FIG. 6B, the distance L2 by which the turn bar 15 should be moved is the same as the separation between center lines Oc and Ob, as shown in FIG. 6B. Thus, the turn bar position control means 35 controls the turn bar 15 to be shifted in the X-direction by distance L2. Alternatively, in the case of the film roll Rb with the intermediate film width Wb, the roll stopper 22 may be kept at the position shown in FIG. 6B for the film roll Rc with the large film width Wc (instead of the position shown in FIG. 6A). It also goes without saying that in the case of a film width Wm2 such that Wb<Wm2<Wc, the distance by which the turn bar 15 is to be moved will be smaller than L2.

It is to be noted that the roll displacing mechanism 23 according to this invention is for the purpose of moving the roll supporting device 20, which axially supports the film roll R, in the axial direction X of the roll so as to adjust the position of the film roll R. In other words, the delicate work of fine positioning of the film roll R can be automated, and this serves to improve the productivity. Unlike the prior art technology, furthermore, the roll displacing mechanism 23 according to this invention serves to prevent the overall size of the packaging machine from undesirably increasing.

It is also to be noted that the roll displacing mechanism 23, as illustrated above, is adapted to change the position of the roll stopper 22 in the X-direction only when the film width is Wa and Wb but not when it is Wc. Thus, the position of the film roll R in the X-direction is changed only between two positions, and the total distance by which the center position of the film roll changes in the X-direction is reduced. In FIG. 6B, symbol Oa indicates the center position of a film roll with film width Wa placed against the roll stopper 22. Thus, according to the prior art technology, the total distance by which the center position of the film roll will change, as the film width changes from Wa to Wc, will be L6, as shown in FIG. 6B. According to this invention, this is reduced to L2 between Wb and Wc and L1 between Wa and Wb, and L1 and L2 are significantly smaller than L6. In other words, a packaging machine according to this invention can be more compact than a prior art packaging machine adapted to accommodate film rolls in the same range.

Figure 7:
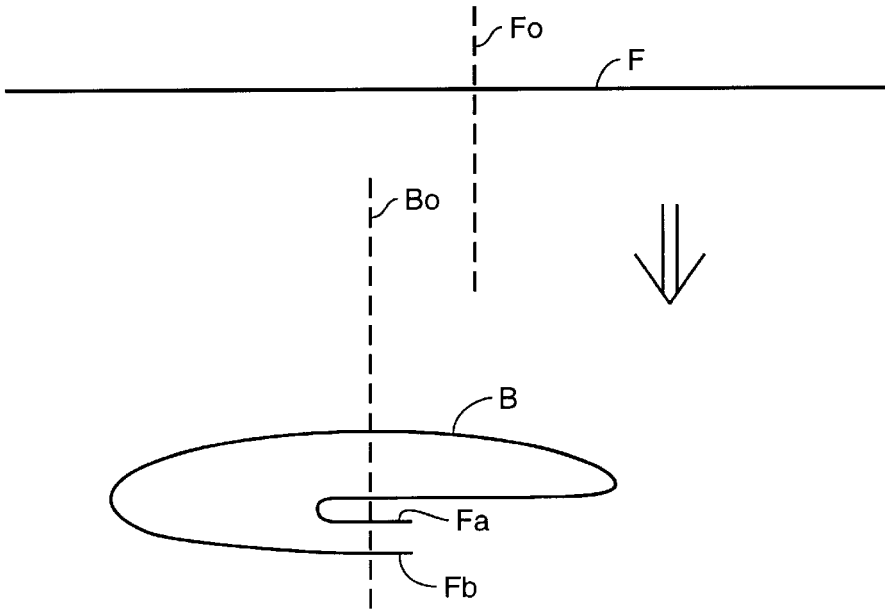
FIG. 7 is a sectional view of a film before and after it is made into a bag by folding one of the side edges.

The invention has been described above basically by way of one example but this example is not intended to limit the scope of the invention. Many modifications and variations are possible within the scope of the invention. For example, when the film F is formed into the shape of a bag, as shown in FIG. 1, it sometimes happens that the center line of the film F fails to coincide with the center line of the former 9 which is the center line of the packaging device H, depending on how the side edge parts Fa and Fb are joined together. If they are superposed as shown in FIG. 7, with one of the side edges (Fa) folded once to be superposed and sealed with the other side edge Fb, for example, the center line F0 of the film F and the center line B0 of the bag B are somewhat displaced one with respect to the other. Since the center line F0 of the film F passes through the center positions Oa, Ob or Oc of the film roll Ra, Rb or Rc as shown in FIGS. 6A or 6B and the center line B0 of the bag B passes through the center positions O1*a*, O1*b* or O1*c* of the turn bar 15 matching with the center of the former 9, this means that the center position Oa, Ob or Oc of the film roll Ra, Rb or Rc is displaced from the center positions O1*a*, O1*b* or O1*c* of the turn bar 15. The roll position control means 36 controls the position of the roll stopper 22 by taking this displacement into consideration.

Figure 8A:
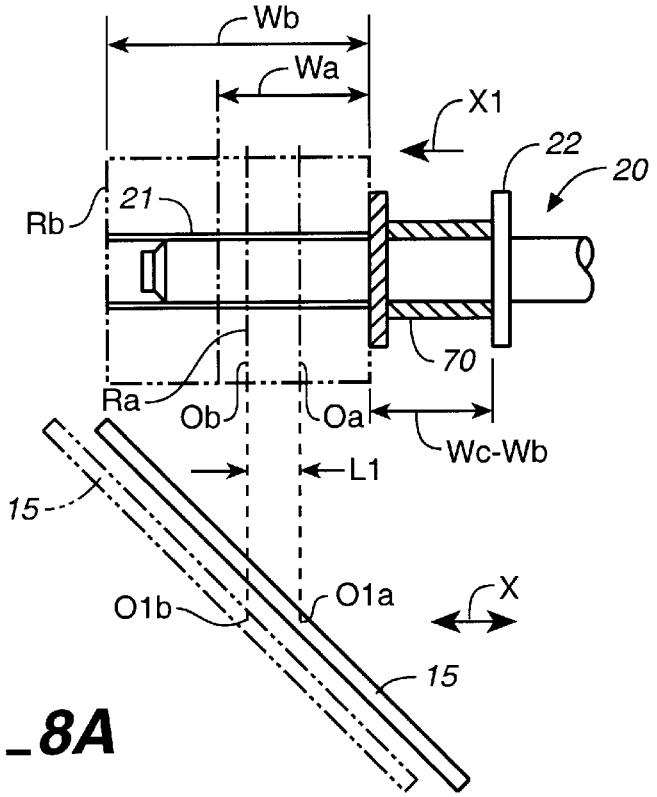
FIGS. 8A and 8B are schematic plan views of a portion of another packaging machine according to a different embodiment of the invention, showing the film roll supporting device at different positions, together with the positions of the turn bar.
Figure 8B:
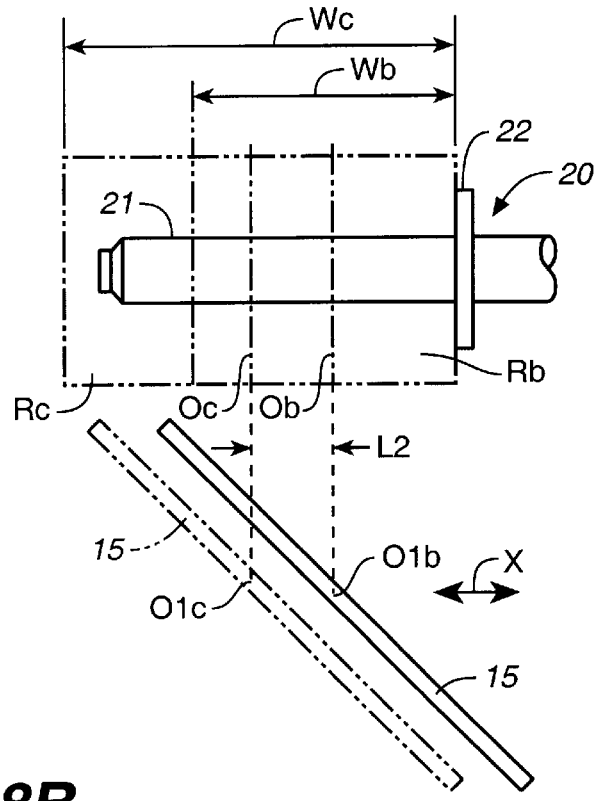
Figure 9:
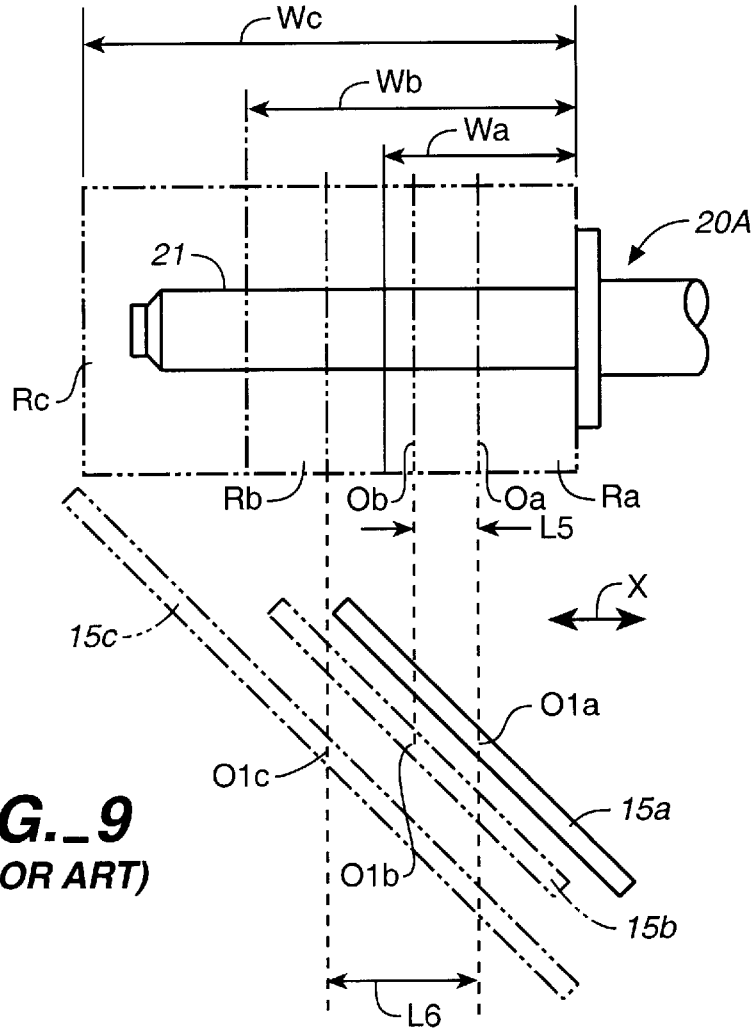
FIG. 9 (PRIOR ART)
FIG. 9 is a schematic plan view of a portion of a prior art packaging machine, showing the positions of its turn bar.

As another alternative, position adjustments of various parts may be effected manually. As shown in FIG. 8A, for example, a spacer 70 with length (Wc−Wb) may be fitted around the support shaft 21 instead of manually moving the roll stopper 22 in the direction of arrow X1 when the film width is between Wa and Wb. If the film width is between Wb and Wc, as shown in FIG. 8B, the position of the roll stopper 22 is the same as shown in FIG. 8A. In other words, the roll stopper 22 does not have to be moved and hence the roll displacing mechanism 23 can be simplified in structure.

It is also to be noted that, although what was referred to as the first mechanism 50 was formed with a pair of rotary arms, this may be substituted by another mechanism for effecting a linear displacement along the transportation route V such as a mechanism similar to the screw bar 60. Similarly, the former roller displacing mechanism 40 need not comprise a screw mechanism. It may be realized, for example, by a timing belt stretched over a pair of pulleys or a mechanism using a fluid cylinder to move the table 54.

What is claimed is:

1. A packaging machine comprising:

a roll supporting device with a support shaft rotatably supporting a film roll which extends in an axial direction, an elongated bag-forming film being wrapped around said film roll;

a bag forming device which pulls out said film from said film roll and forms said film into a shape of a bag; and a packaging device for filling said bag-shaped film with articles to be packaged and sealing said film to produce a package;

said bag forming device including a former for bending said film into a tubular form, a former roller for guiding said film in a film transportation direction to said former, and a former roller displacing mechanism, said former being selected from a plurality of formers with different sizes, said former roller displacing mechanism serving to move said former roller to a former roller position according to the size of said selected former along said film transportation direction, said former roller displacing mechanism including a first mechanism for supporting said former roller and moving said former roller to a plurality of different positions with respect thereto in said film transportation direction and a second mechanism for moving said first mechanism to a plurality of different positions in said film transportation direction.

2. The packaging machine of claim 1 wherein said first mechanism includes a rotary member which supports said former roller and is rotatable around an axis perpendicular to said film transportation direction.

3. The packaging machine of claim 2 wherein said second mechanism includes a screw mechanism serving to cause said rotary member to undergo a linear motion along said film transportation direction.

4. The packaging machine of claim 1 further comprising a controller including a former roller control means for controlling said former roller displacement mechanism to adjust the position of said former roller along said film transportation direction according to the width of said film.

5. The packaging machine of claim 2 further comprising a controller including a former roller control means for controlling said former roller displacement mechanism to adjust the position of said former roller along said film transportation direction according to the width of said film.

6. The packaging machine of claim 3 further comprising a controller including a former roller control means for controlling said former roller displacement mechanism to adjust the position of said former roller along said film transportation direction according to the width of said film.

* * * * *